US006150772A

United States Patent [19]

Crane

[11] Patent Number: 6,150,772

[45] Date of Patent: Nov. 21, 2000

[54] GAS DISCHARGE LAMP CONTROLLER

[75] Inventor: David N. Crane, Woodland, Wash.

[73] Assignee: Pacific Aerospace & Electronics, Inc., Wenatchee, Wash.

[21] Appl. No.: 09/200,204

[22] Filed: Nov. 25, 1998

[51] Int. Cl.[7] ..... G05F 1/00

[52] U.S. Cl. ..... 315/291; 315/307

[58] Field of Search ..... 315/291, 307, 315/297, 294, 295, 299; 340/471, 825.57; 364/145

[56] References Cited

U.S. PATENT DOCUMENTS

| | | | |
|---|---|---|---|
| 4,484,190 | 11/1984 | Bedard | 340/825.57 |
| 4,521,843 | 6/1985 | Pezzolo et al. | 364/145 |
| 5,569,983 | 10/1996 | McGuire et al. | 315/297 |
| 5,691,696 | 11/1997 | Mazies et al. | 340/417 |
| 5,739,645 | 4/1998 | Xia et al. | 315/307 |
| 5,949,197 | 9/1999 | Kastner | 315/291 |

*Primary Examiner*—Don Wong
*Assistant Examiner*—Chuc D. Tran
*Attorney, Agent, or Firm*—Ipsolon LLP

[57] ABSTRACT

A gas discharge lamp controller controls and drives a gas discharge lamp, which may be either a hot cathode lamp or a cold cathode lamp, and may or may not be a fluorescent lamp. The lamp controller separately varies the current and the voltage that are delivered to the lamp to drive it in an illuminated state over a wide range of brightnesses, including very low brightness levels without flicker. The lamp controller includes a brightness control circuit and a driver circuit. A memory circuit stores values for generating arc currents that correspond to a selected brightness and values for generating arc voltages that correspond to the brightness represented by the digital control value. Digital to analog converters convert the arc voltage and arc current values to analog control signals that are delivered to an arc current driver circuit and an arc voltage driver circuit. A photodetector may provide feedback as to the brightness of light generated by the lamp to control different phases of operation (e.g., start-up and normal operation) as well as to monitor the accuracy at which the lamp generates selected light brightnesses.

36 Claims, 9 Drawing Sheets

GAS DISCHARGE LAMP CONTROLLER

FIELD OF THE INVENTION

The present invention relates to controllers for gas discharge lamps and, in particular, to a gas discharge lamp controller that allows a lamp to be operated over a wide range of illumination brightnesses including very low illumination brightnesses.

BACKGROUND AND SUMMARY OF THE INVENTION

Gas discharge lamps are used in a wide variety of applications and environments including direct illumination and display illumination. An example of display illumination is backlighting for liquid crystal or other pixelated transmissive displays. A liquid crystal display backlight often includes one or more gas discharge lamps, which can be cold cathode fluorescent lamps, hot cathode lamps, or other types of lamps as is known in the art. Backlight illumination from the gas discharge lamp is diffusively transmitted through the display panel to a user or observer.

In many consumer applications, such as laptop computers, the illumination brightness provided by a gas discharge lamp varies over a relatively narrow range. The brightness range in such applications can have a dimming ratio of about 30:1, which represents the ratio between the maximum and minimum illumination brightnesses. In contrast, some industrial and military applications can require dimming ratios of up to about 20,000:1. An exemplary application in which such high dimming ratios are desirable is liquid crystal displays used for aviation control instruments, particularly for military aircraft. Control instruments in a military aircraft must be viewable over a wide range of lighting conditions ranging from extremely bright sunlight requiring a display output of about 200 foot-lamberts to pitch darkness in which a display brightness of 0.01 foot-lambert or less is desirable.

Current gas-discharge lamp energizing circuits include a voltage transformer and an inductor (ballast) connected in series with the lamp. The operation of such energizing circuits may be described by considering the transformer voltage to be constant after energizing the lamp, as is typical, and recalling that the voltage drop across an inductor is dependent on the time derivative of the current through the inductor. When the lamp is energized (i.e., at turn-on) there is no voltage drop across the inductor until a breakdown or start-up voltage occurs across the lamp.

The breakdown voltage ionizes gases within the lamp and it conducts current, which causes a voltage drop across the inductor (ballast). Gas ionization dynamics in the lamp cause the voltage across it to decrease as the current through it increases. After the arc start-up, the inductor (ballast) automatically provides a constant voltage and, for a given light output, a constant current, to maintain a controlled low-power arc. Ballasts usually have magnetic cores to reduce their size, and sometimes the ballast functions are incorporated into the transformer.

In typical energizing circuits, the ballast provides a preset lamp operating voltage and dimming is achieved by limiting current. For example, dimming methods employ current-restricting waveform-modulating techniques, such as pulse-width modulation or pulse-train gating, to limit the energizing power delivered to the lamp.

Limited dimming ratios in typical gas discharge lamps arise from the inability of conventional ballasts to maintain a perceptively constant arc at low illumination levels. At lower illumination levels, the arc in a gas discharge lamp driven by a conventional ballast undergoes perceivable interruptions that cause the lamp to appear to "flicker." A lamp is considered not to be in normal operation when it is flickering. High illumination levels are instead limited by physical capabilities of the lamp.

In accordance with the present invention a gas discharge lamp controller controls and drives a gas discharge lamp, which may be either a hot cathode lamp or a cold cathode lamp, whether fluorescent lamp or not. The lamp controller separately varies the current and the voltage that are delivered to the lamp to drive it in an illuminated state over a wide range of brightnesses, including very low brightness levels without flicker. The range of brightnesses is sometimes referred to as the dimming ratio, which is the ratio between the brightest and dimmest illuminated states of the lamp. In one implementation, for example, the lamp controller circuit can provide a lamp with a dimming ratio of over 90,000:1.

The lamp controller includes a brightness control circuit and a driver circuit. In one implementation, the brightness control circuit includes a user-manipulated analog dimmer control, such as variable control voltage (e.g., 0–5 volts), for controlling illumination brightness. For example, a user can control illumination brightness by manipulating a control (e.g., a potentiometer) that selects a magnitude for the variable control voltage. The magnitude of the analog control voltage represents a brightness to be formed by the lamp. An analog-to-digital converter receives the control voltage and generates a digital control value corresponding to the control voltage magnitude.

The digital control value is delivered to a microprocessor or a microcontroller that generates arc current and arc voltage control signals for generating the illumination brightness selected by the user. Signal values corresponding to the arc current and arc voltage control signals are stored, for example, in a memory circuit coupled to the microcontroller. Digital to analog converters convert the arc voltage and arc current control values to analog control signals that are delivered to alamp driver circuit. In one implementation, the lamp driver circuit generates lamp drive signals in the form of current pulses corresponding to the selected brightness. The current pulses for a range of brightnesses may have a fixed pulse period or any of a range of pulse periods that are separately selectable according to the brightness that is selected. While this implementation employs a programmed controller (e.g., a microcontroller) and other digital circuitry, it will be appreciated that the arc current and arc voltage could in the alternative be controlled separately by digital circuitry without a programmed controller or by analog circuitry.

An aspect of the present invention is the determination that flickering at lower illumination levels can be prevented by increasing the voltage of the arc drive signal at low brightness illumination levels. In contrast, current gas-discharge lamp energizing circuits apply a drive signal of a fixed voltage and achieve lamp dimming by varying the arc current alone. Separate and independent control of the arc current and arc voltage allow the arc voltage to be increased at the relatively low arc currents associated with low brightness illumination. Stable low brightness illumination allows the dimming ratio of even conventional lamps to be extended dramatically, thereby providing illumination ranges that are suitable to a wide variety of background (e.g., environmental) lighting conditions.

Additional objects and advantages of the present invention will be apparent from the detailed description of the preferred embodiment thereof, which proceeds with reference to the accompanying drawings.

DETAILED DESCRIPTION OF PREFERRED EMBODIMENTS

Figure 1:
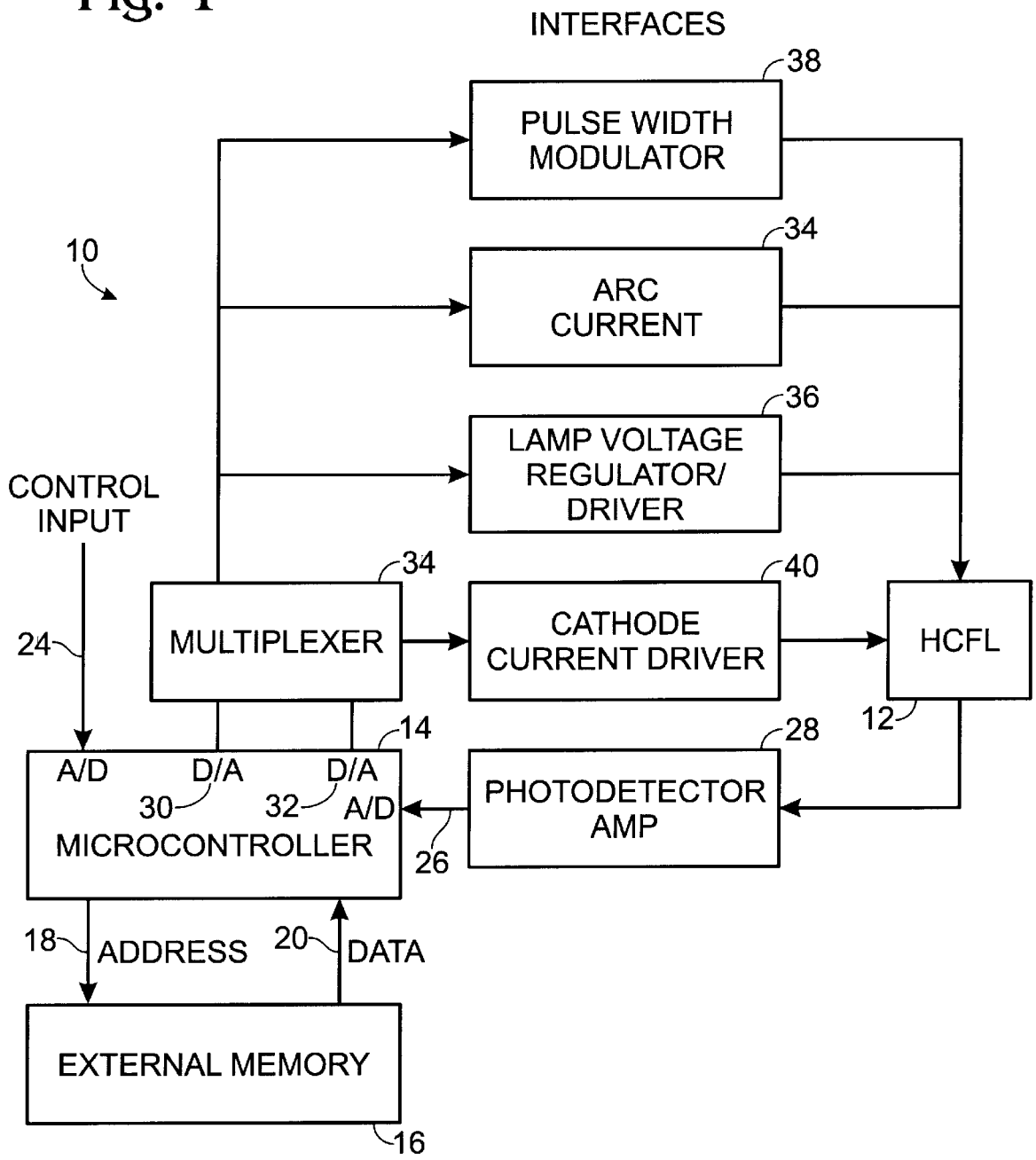
FIG. 1 is a functional block diagram of a gas discharge lamp controller for driving a gas discharge lamp.

FIG. 1 is a functional block diagram of a gas discharge lamp controller 10 for controlling and driving a gas discharge lamp 12, which may be either a hot cathode lamp or a cold cathode lamp, or a fluorescent lamp. Controller 10 separately varies the current and the voltage that are delivered to lamp 12 to drive it in an illuminated state over a wide range of brightnesses, including very low brightness levels without flicker. The range of brightnesses is sometimes referred to as the dimming ratio, which is the ratio between the brightest and dimmest illuminated states of lamp 12. In one implementation, for example, controller 10 can provide lamp 12 with a dimming ratio of over 90,000:1. In comparison, conventional ballast drivers for fluorescent lamps achieve dimming ratios of merely about 300:1.

An exemplary application in which high dimming ratios for gas discharge lamps are desirable is liquid crystal display backlights used for aviation control instruments, particularly for military aircraft. Control instruments in a military aircraft must be viewable over a wide range of lighting conditions ranging from extremely bright sunlight requiring a display output of about 200 foot-lamberts to pitch darkness in which a display brightness of 0.01 foot-lambert or less is desirable. These brightnesses have a dimming ratio of about 20,000:1, which is beyond the capability of conventional technologies.

Controller 10 includes a microcontroller 14 coupled to a memory 16 (e.g., 64 k×8 bit) by address lines 18 and data lines 20. Memory 16 stores values corresponding to arc currents, arc voltages, and pulse widths for providing display brightnesses over a large dimming ratio (e.g., 20,000:1). If lamp 12 is a hot cathode lamp, as in this illustrated embodiment, memory 16 also stores values corresponding to cathode currents for heating the lamp cathodes. Memory 16 delivers selected ones of these values to microcontroller 14 over parallel data lines 20 in response to addresses that microcontroller 14 delivers to memory 16 over parallel address lines 18. Operating instructions or software for microcontroller 14 may be stored in an integrated memory, such as an Electrically Erasable Programmable Read-Only Memory (EEPROM), if included in microcontroller 14, or a separate memory. In addition, microcontroller 14 may include a serial interface (not shown) for installing or manipulating programming or software instructions that control operation of microcontroller 14.

Figure 2A:
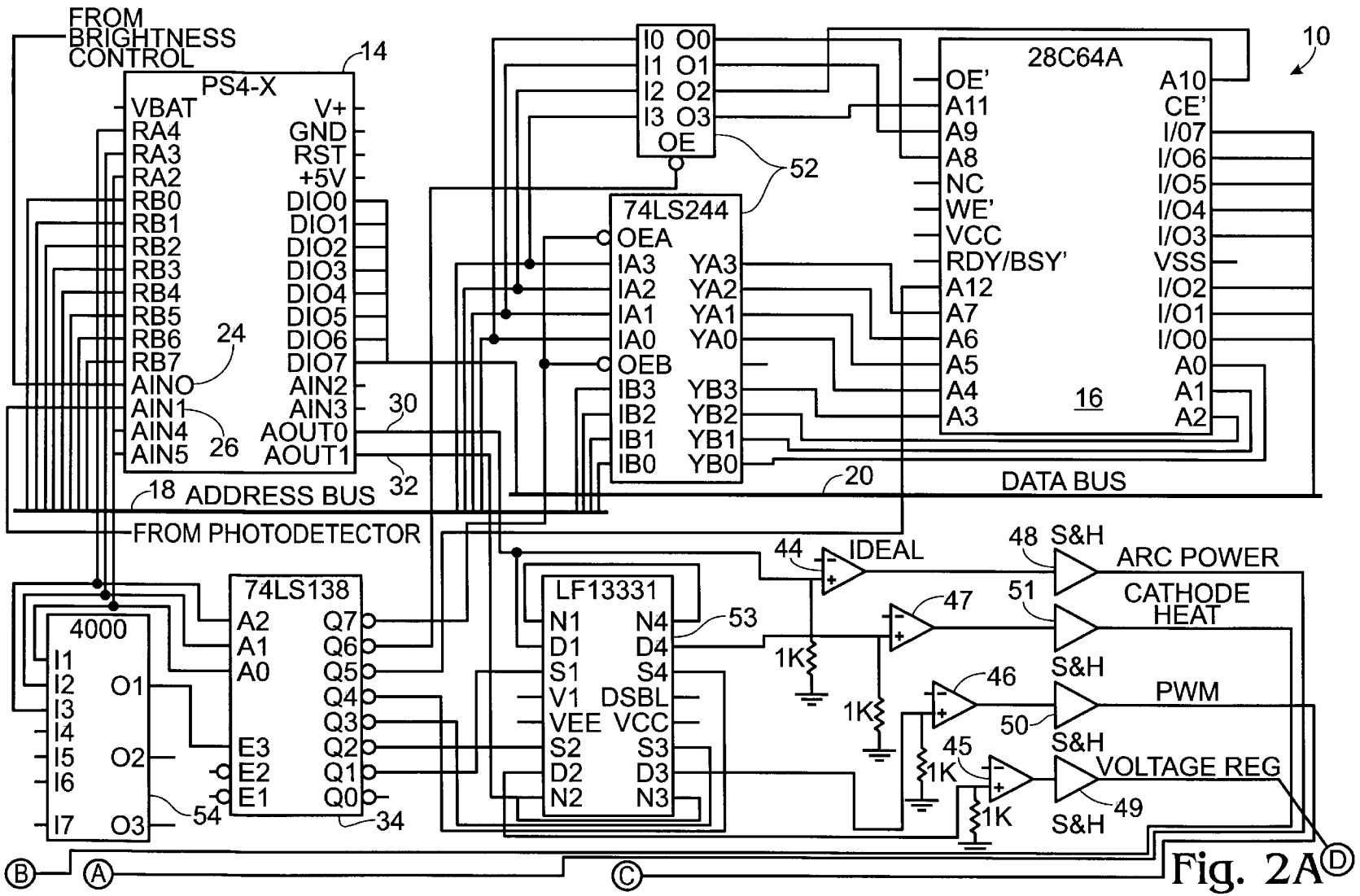
FIG. 2 is a circuit schematic diagram of one implementation of a controller circuit of FIG. 1 for providing an arc current driver control and a separate arc voltage control.
Figure 2B:
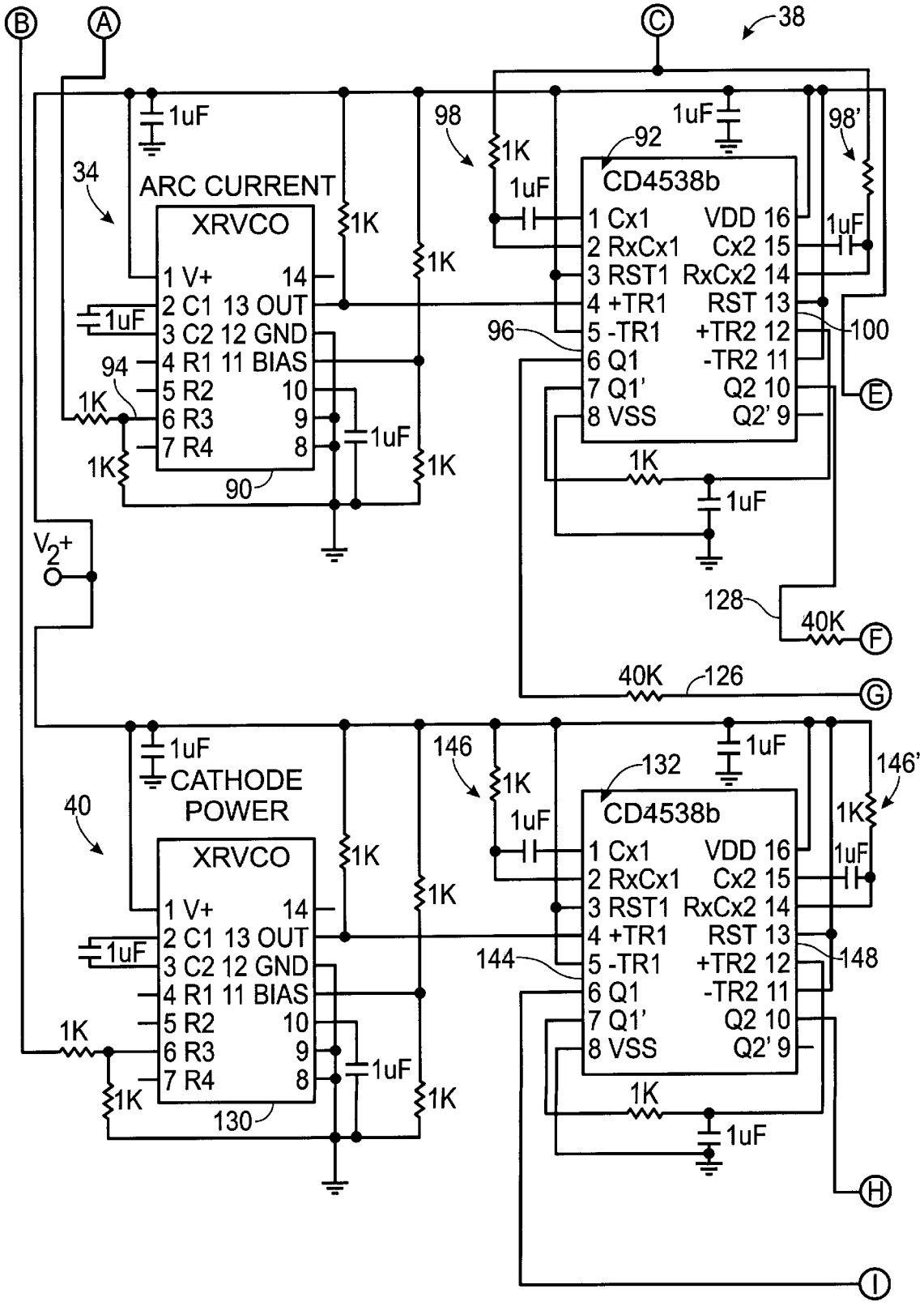
Figure 2C:
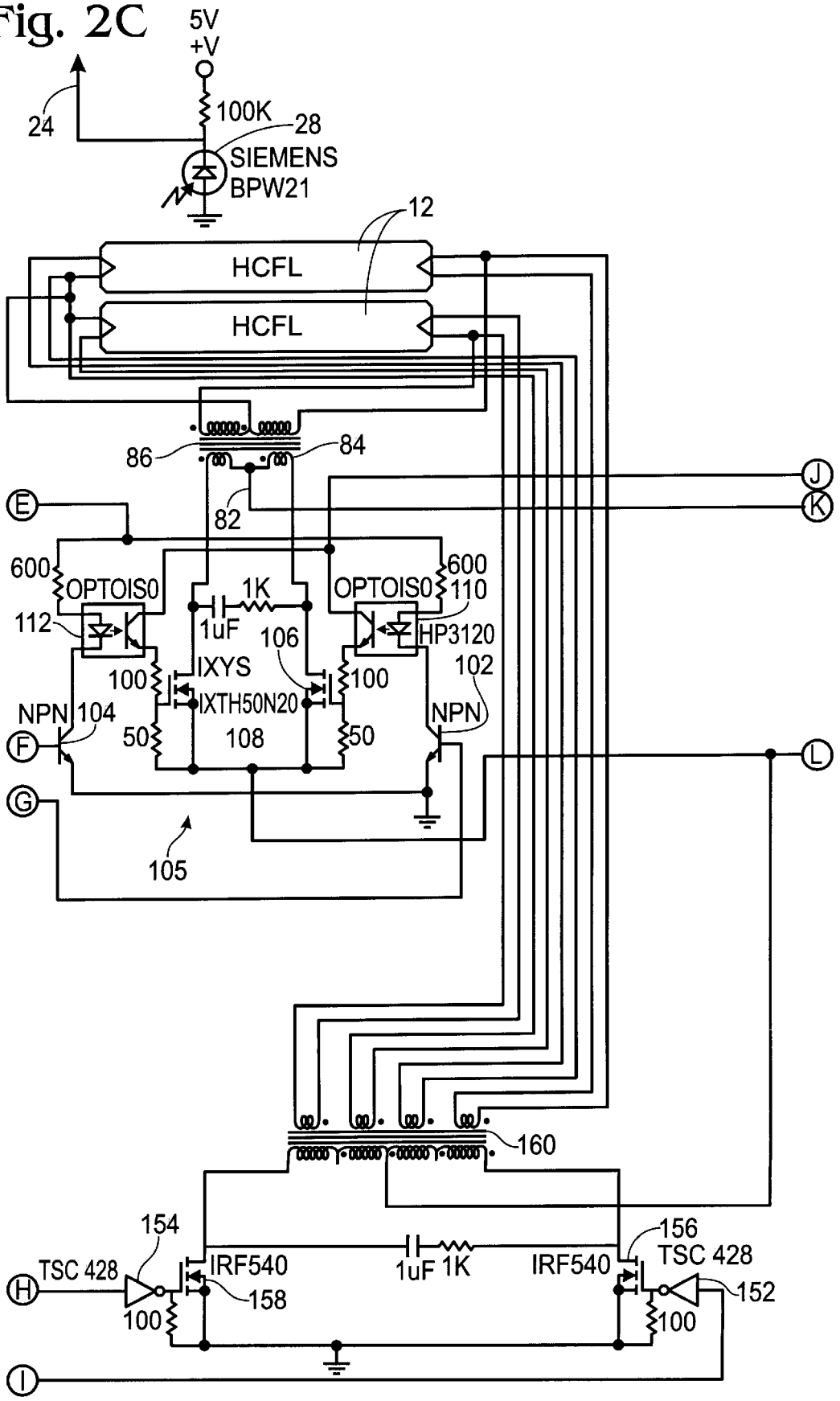
Figure 2D:
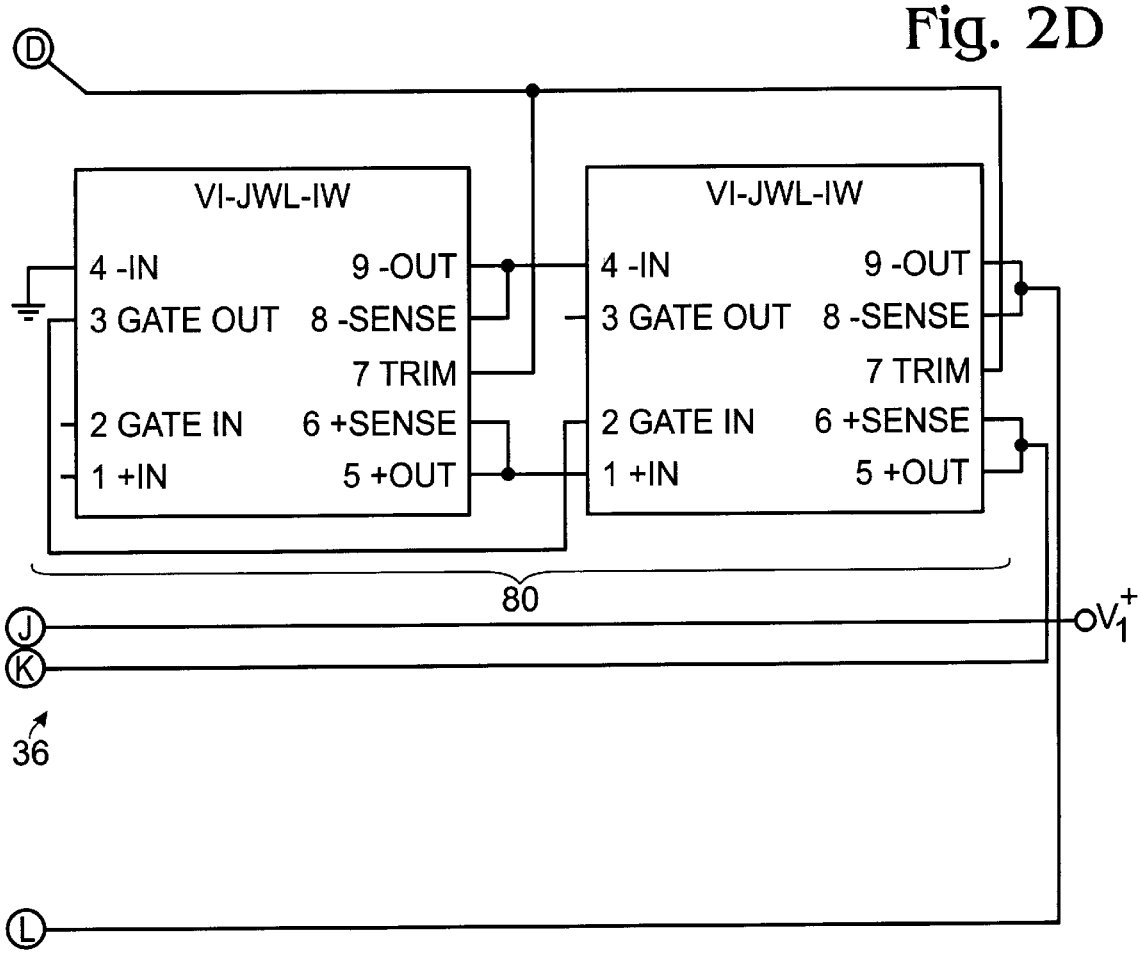

FIGS. 2A–2C are a circuit schematic diagram of one implementation of controller circuit 10 of FIG. 1 for providing an arc current control and a separate arc voltage control. (The terms "arc" and "discharge" are used herein interchangeably to refer to the ionization of gas within lamp 12 when it is operated.) The following description is made with reference to an exemplary microcontroller integrated circuit, particularly a PS4-X microcontroller available from Micromint, Inc. of Vernon, Conn. Reference to this particular integrated circuit is for purposes of illustration and is not a limitation on the types of microcontrollers or micrprocessors that can be used as microcontroller 14.

Microcontroller 14 includes a pair of analog-to-digital converter inputs 24 and 26 that receive, respectively, an analog control input signal representing an illumination brightness selected by a user and an analog brightness measurement signal generated by a photodetector amplifier 28 that receives light from lamp 12. The analog control input signal may be generated by any variable analog voltage source controllable by a user such as, for example, a potentiometer-controlled variable voltage source. Photodetector amplifier 28 provides feedback to microcontroller 14 as to the brightness of light generated by lamp 12.

Microcontroller 14 includes one or more integrated analog-to-digital converters (not shown) for converting the analog control input signal and the analog brightness measurement signal to corresponding digital values. It will be appreciated that other implementations could employ a microcontroller or microprocessor without an integral analog-to-digital converter and instead one or more separate analog-to-digital converter circuits could be employed.

Microcontroller 14 provides at digital-to-analog converter outputs 30 and 32 analog control values for controlling the arc current and arc voltage in lamp 12, including separately the pulse width of voltage pulses driving the arc, that together deliver to lamp 12 an arc drive signal having a current and a voltage that provide a brightness that is selected by a user. Microcontroller 14 also provides at one of digital-to-analog converter outputs 30 and 32 analog control values for controlling the cathode heating current delivered to the cathodes of lamp 12.

A multiplexer 34 receives the analog control values provided at digital-to-analog convert outputs 30 and 32, and selectively applies the control values to lamp 12 via analog controller sub-circuits 34, 36, 38, and 40. It will be appreciated that an implementation of controller 10 employing a lamp 12 of a cold cathode type would not provide control values for the cathode heating current or include its associated controller circuitry. Such an alternative implementation would otherwise be substantially the same as the present implementation.

In the implementation illustrated in FIG. 2, analog controller sub-circuits 34, 36, 38, and 40 include respective amplifiers 44, 45, 46, and 47 (shown symbolically as operational amplifiers) for scaling the analog control values and sample-and-hold circuits 48, 49, 50, and 51 for maintaining the control voltages. In this illustrated implementation, microcontroller 14 employs 11-bit addresses (RA2–RA4 and RB0–7) while memory 16 employs 8-bit addresses. Accordingly, controller 10 includes 3-output octal buffer and line drivers 52, a 3-line to 8-line decoder/demultiplexer 53, and a 3-input NOR-gate 54 to convert between the 11-bit addressses of microcontroller 14 and pairs of 8-bit address bytes compatible with memory 16. It will be appreciated that such digital data format conversions are well known in the art.

To initially light lamp 12, which is sometimes referred to as lamp start-up, microcontroller 14 delivers to analog controller sub-circuits 34, 36, 38, and 40 control values for lamp start-up rather than the control values for normal operation at the selected brightness. Microcontroller 14 distinguishes normal operation from lamp start-up by the respective presence and absence of light from lamp 12, as detected by a photodetector 28. Photodetector 28 provides feedback to microcontroller 14 as to whether an arc is present in (i.e., whether light is emitted from) lamp 12.

In one implementation of lamp start-up, microcontroller 14 operates as a sequencer that provides "soft-start" of the cathodes in lamp 12 by delivering control values to cathode power controller circuit 40 to cause it to increase successively cathode heating power delivered to the cathodes of lamp 12. After adequate cathode heating is completed in this manner, microcontroller 14 delivers control values to arc current controller circuit 34, arc voltage controller circuit 36, and pulse width modulation circuit 38 to provide a high voltage, low current "open circuit" with narrow pulse widths (e.g., 1 microsecond) to initiate the arc or discharge. For example, microcontroller 14 could initiate execution of its program at a pre-selected memory address (e.g., address 00), where a "goto" statement would direct the program to an initialization and warm-up routine.

Initiation of the arc or discharge generates light at lamp 12. Photodetector 28 detects the light and delivers a light feedback signal to analog-to-digital input 26 of microcontroller 14, which successively adjusts the arc current, arc voltage, and pulse width modulation control values from the "open circuit" arc initiation power to the power corresponding to the selected lamp brightness. For example, after execution of an initialization and warm-up routine, microcontroller 14 could read the selected brightness level and retrieve the corresponding control values from memory 16.

Furthermore, the resulting light level can be detected by photodetector 28 and compared to an expected light measurement level (e.g., stored in memory 16) corresponding to the selected brightness. Microcontroller 14 can then adjust the arc current, arc voltage, and/or pulse width modulation control values in response to differences between the resulting light level detected by photodetector 28 and the corresponding expected light measurement level. Such real-time adjustment of the arc current, arc voltage, and/or pulse width modulation control values can compensate for variations over time in the light output performance of lamp 12.

Referring to FIG. 2B, the arc voltage control signal provided microcontroller 14 is delivered to a variable voltage source 80 that generates a corresponding arc control voltage. In the illustrated implementation, variable voltage source 80 includes a series-connected pair of voltage source integrated circuits. These integrated circuits are connected together to provide voltage source 80 with a 12-bit voltage range.

Figure 3:
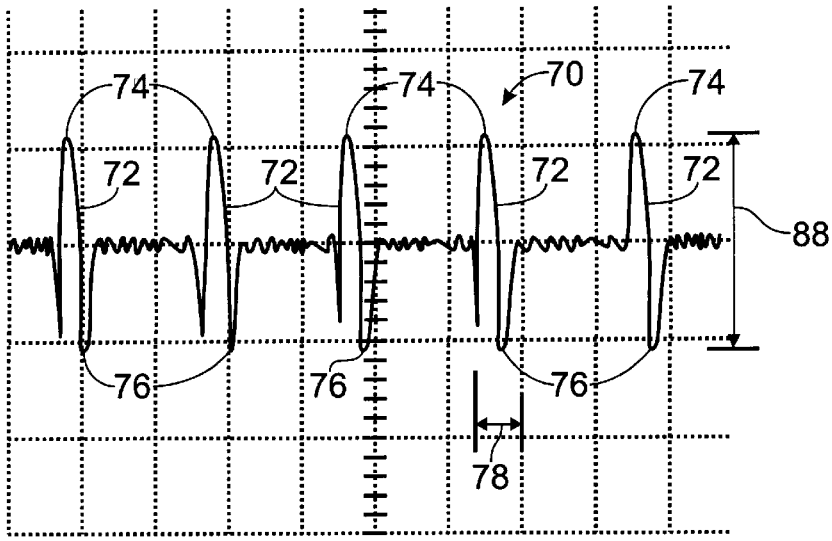
FIG. 3 illustrates an exemplary gas discharge lamp drive signal having successive drive signal pulses.

The arc voltage control is delivered to a center tap 82 of a primary coil 84 of a step-up voltage transformer 86 that is coupled to the cathodes of lamp 12. The voltage control sets a voltage magnitude 88 of a drive signal that generates the arc in lamp 12 during normal operation. FIG. 3 illustrates an exemplary drive signal 70 having successive drive signal pulses 72. Each drive signal pulse 72 has, for example, a positive-going signal component 74 and a negative-going signal component 76 and a period 78, as described below in greater detail. The configuration and frequency of drive signal pulses 72, and hence the current magnitude of drive signal 70, are provided in this implementation by cooperation between a voltage-controlled oscillator 90 and a dual monostable multivibrator (one-shot) 92.

Voltage-controlled oscillator 90 receives at its analog control input 94 the arc current control voltage provided at sample and hold circuit 48. Voltage-controlled oscillator 90 generates a square wave output signal having a frequency corresponding to the magnitude of the analog control voltage. The square wave output signal is delivered to a first monostable multivibrator 96 of dual monostable multivibrator 92. First monostable multivibrator 96 triggers on a leading edge of the square wave output signal and generates a one-shot output pulse.

As this one-shot output pulse goes low, a complementary one-shot output pulse goes high. The complementary one-shot output pulse has a period set in part by a resistor-capacitor pair 98 and is delivered to a second monostable multivibrator 100 of dual monostable multivibrator 92 to trigger therefrom a one-shot output pulse having a period set in part by a resistor-capacitor pair 98'. In addition, resistor-capacitor pairs 98 and 98' are connected to the output of sample-and-hold circuit 50 to receive a pulse width modulation control voltage. For example, higher pulse width modulation control voltages increase the discharge periods for the resistor-capacitor pairs and hence increase the pulse periods.

The one-shot output pulses from first and second monostable multivibrators 96 and 100 are coupled to and drive transistor switches 102 and 104, respectively, of a lamp drive circuit 105. Transistor switches 102 and 104 are coupled between a supply voltage and ground and communicate with a pair of power transistors 106 and 108 via opto-isolators 110 and 112, respectively. Power transistors 106 and 108 are connected to respective opposed legs of step-up voltage transformer 86. Opto-isolators 110 and 112 provide isolation between transformer 86 and dual monostable multivibrator 92 to prevent feedback from the former from interfering with operation of the latter.

In response to the one-shot pulses, transistor switches 102 and 104 momentarily and at different times close to ground, which draws current through photo-emitters of corresponding opto-isolators 110 and 112 to generate corresponding current pulses at power transistors 106 and 108. The current pulses at power transistors 106 and 108 are applied as drive signal current pulses to the respective opposed legs of step-up voltage transformer 86. The drive signal current pulses provide the configuration of drive signal pulses 72 and the control voltage delivered to a center tap 82 provides the magnitude of the pulses.

Controller 10 provides separate and independent control of the arc current and the arc voltage delivered to lamp 12. The current is regulated by controlling the repetition rate and period of signal pulses 72. Drive signal 70 has a power duty cycle that is determined by dividing the period of drive signal pulses 72 by the period between repeated portions of successive pulses. The power duty cycle corresponds to the brightness or light intensity of lamp 12.

The separate control of arc current and arc voltage allow lamp 12 to be driven flicker-free at lower brightness levels than have been previously achieved with conventional controllers. It is believed that such low brightness levels are achieved by the ability to increase the arc voltage at the low arc currents associated with low brightness levels to maintain a perceptively constant arc. As a result, controller 10 provides dimming ratios of 20,000:1, which are suitable for liquid crystal display backlights for avionics controls, and have been demonstrated to provide dimming ratios of 90,000:1 and even higher.

Separate control of the pulse width modulation provides optional additional control over the power delivered to lamp 12, whereby shorter pulse periods (e.g., 1 μS) deliver less power (e.g., during start-up and low brightness operation) and longer pulse periods (e.g., 10 μS) deliver more power (e.g., during high brightness operation). Alternative implementations may employ separate control of arc voltage and arc current without separate control of pulse period, as described below in greater detail.

Brightness characteristics of different types of lamp 12 vary due to a wide range of lamp characteristics, as is common for discharge or arc lamps. For a particular model of lamp, brightness variations for different arc voltages or different arc currents typically cannot be modeled accurately. Instead, brightness variations for different arc voltages and different arc currents are better determined by empirical measurements.

In one implementation of this invention, the arc current control values, arc voltage control values, and pulse period control values stored in memory 16 to provide selected lamp brightnesses for a particular model of lamp are based upon empirical measurements of current, voltage, pulse period, and brightness for that lamp model. For example, the brightnesses of a test lamp can be measured over multiple voltages for each of multiple currents and pulse periods. Conversely, the brightnesses of the test lamp can be measured over multiple currents for each of multiple voltages and pulse periods. The arc currents, arc voltages, and pulse period control values stored in memory 16 can be selected to provide successive brightnesses for successive control signal values.

Table 1 lists currents and voltages for several exemplary lamp brightnesses for variable pulse periods. As with Table 1, the currents, voltages, and pulse periods are measured at center tap 82 of primary coil 84 of transformer 86 and hence are proportional to the corresponding arc current and arc voltage control values stored in memory 16.

TABLE 1

| Sample No. | Brightness (ft-L) | Center Tap Current (mA) | Primary Voltage (V) | Pulse Width Volts | Pulse Width (μS) | Frequency (kHz) |
|---|---|---|---|---|---|---|
| 1 | 0.1 | 0 | 18.3 | 8 | 2 | 0.5 |
| 2 | 24.1 | 0 | 17.1 | 8 | 2 | 2 |
| 3 | 37.1 | 0 | 14.3 | 8 | 2 | 4 |
| 4 | 628 | 200 | 14.6 | 3.8 | 5 | 4 |
| 5 | 1000 | 300 | 12.5 | 3.8 | 5 | 6.25 |
| 6 | 1720 | 700 | 13.4 | 3.8 | 5 | 11.8 |
| 7 | 2640 | 1000 | 14.1 | 3.8 | 5 | 16 |

Table 2 lists currents and voltages for several exemplary lamp brightnesses for a fixed pulse period (e.g. 10 μS). The currents and voltages are measured at center tap 82 and hence are proportional to the corresponding arc current and arc voltage control values stored in memory 16.

TABLE 2

| Sample No. | Brightness (ft-L) | Current (A) | Primary Voltage (V) | Breakdown Voltage (Vpp) | Time (μS) |
|---|---|---|---|---|---|
| 1 | 724 | 0.56 | 20 | 200 | 780 |
| 2 | 1,000 | 0.57 | 14 | 180 | 780 |
| 3 | 1,750 | 1.0 | 11 | 140 | 500 |
| 4 | 2,600 | 1.74 | 10 | 120 | 250 |
| 5 | 3,700 | 2.3 | 9 | 110 | 140 |
| 6 | 5,500 | 4.0 | 9 | 100 | 95 |
| 7 | 7,000 | 5.6 | 9 | 90 | 60 |

Primary voltage refers to the adjustable potential measured at center tap 82. The time refers to the period between successive voltage pulses of the fixed pulse period. The breakdown voltage is the peak-to-peak measurement of the breakdown voltage of lamp 12 for the indicated brightness. The variation in the breakdown voltage at different brightness levels is an indication of the operation of the present invention.

Figure 4:
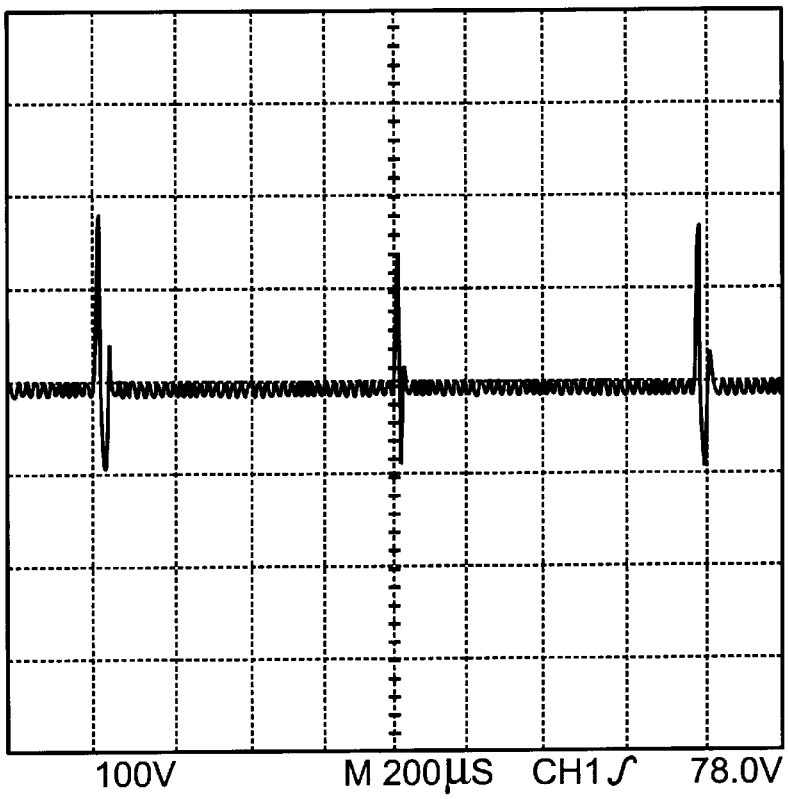
FIGS. 4–9 are voltage signal traces showing the voltages of exemplary drive signals for different lamp brightnesses.
Figure 5:
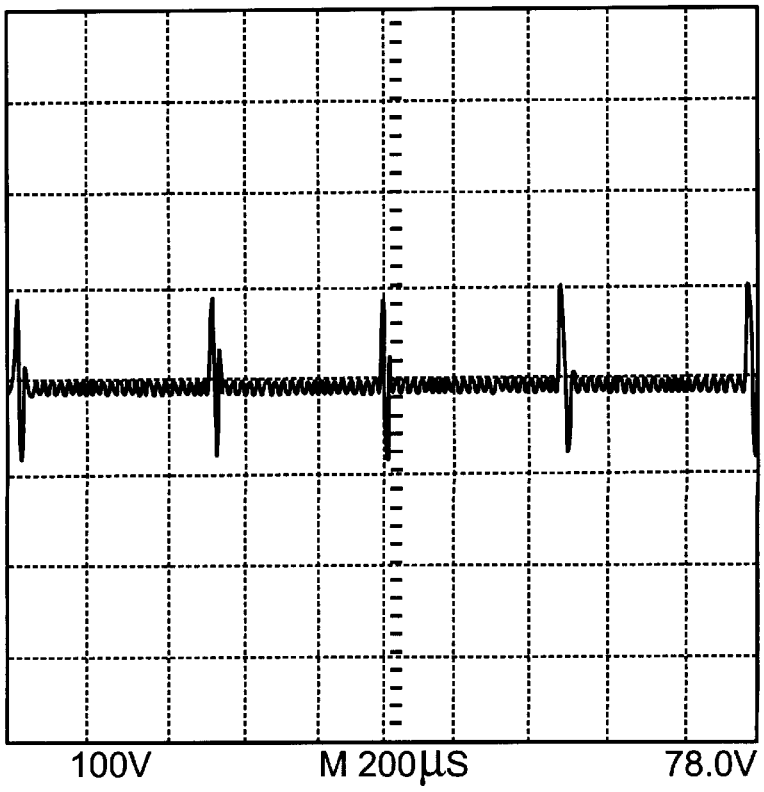
Figure 6:
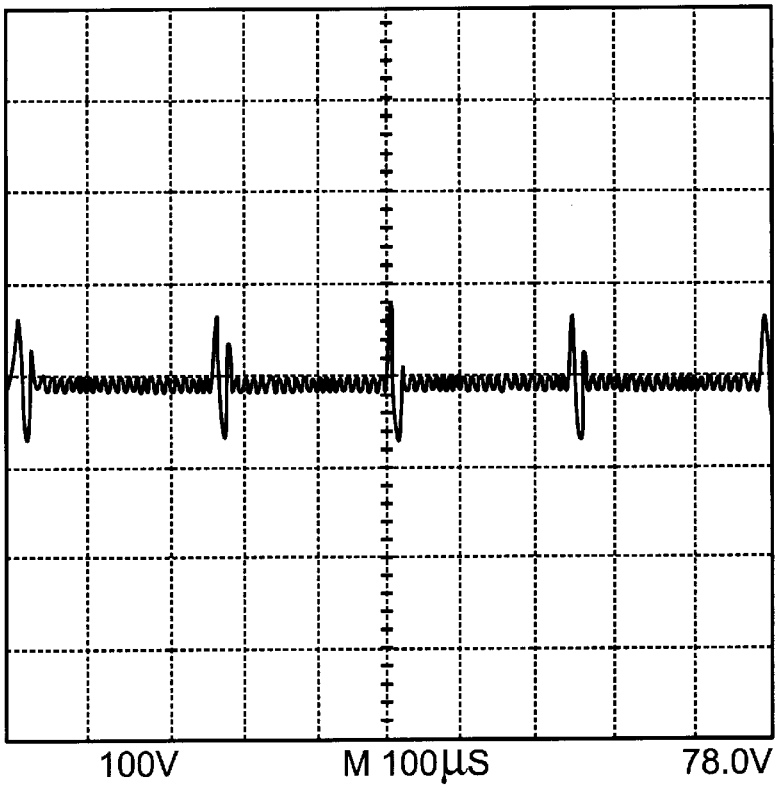
Figure 7:
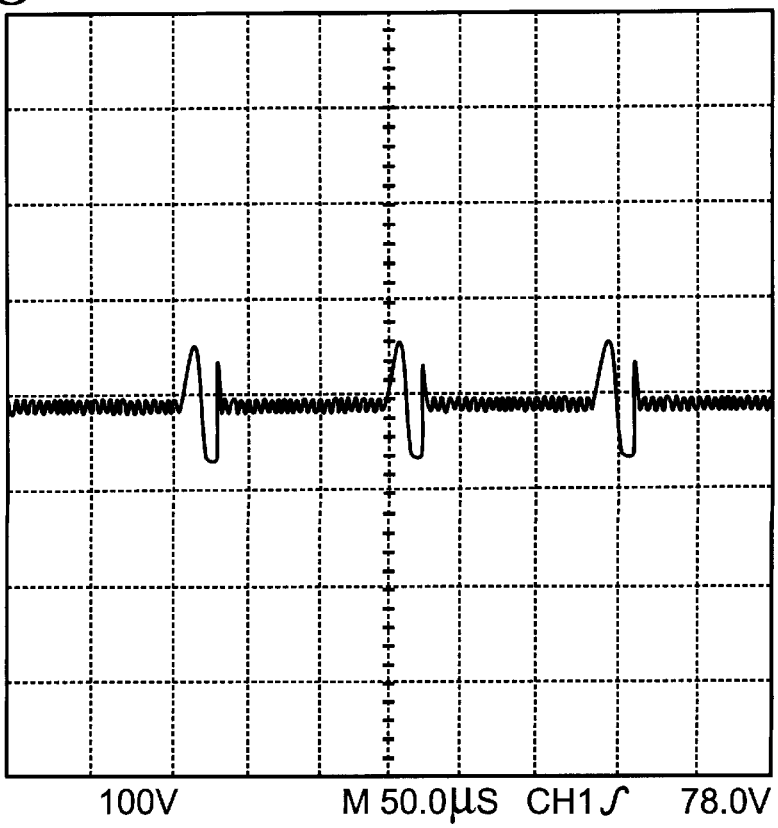
Figure 8:
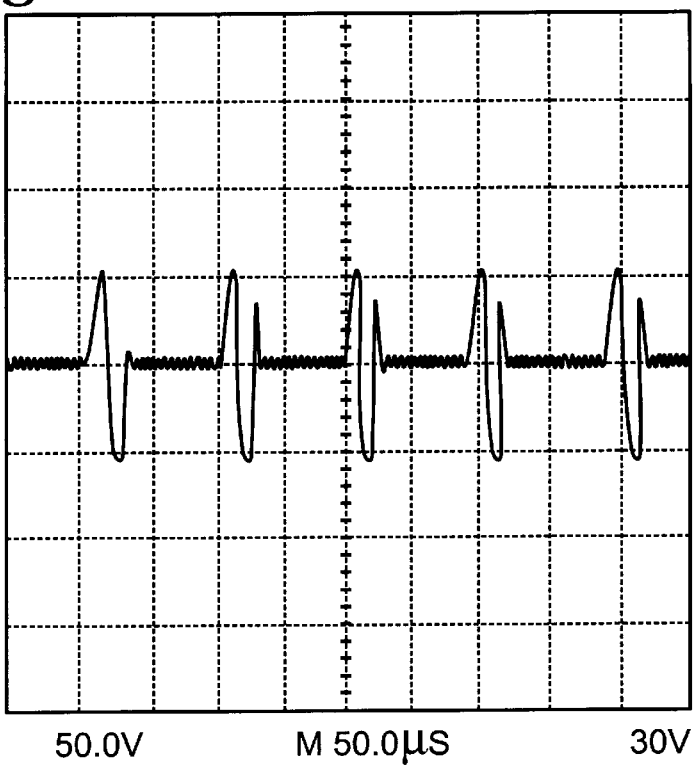
Figure 9:
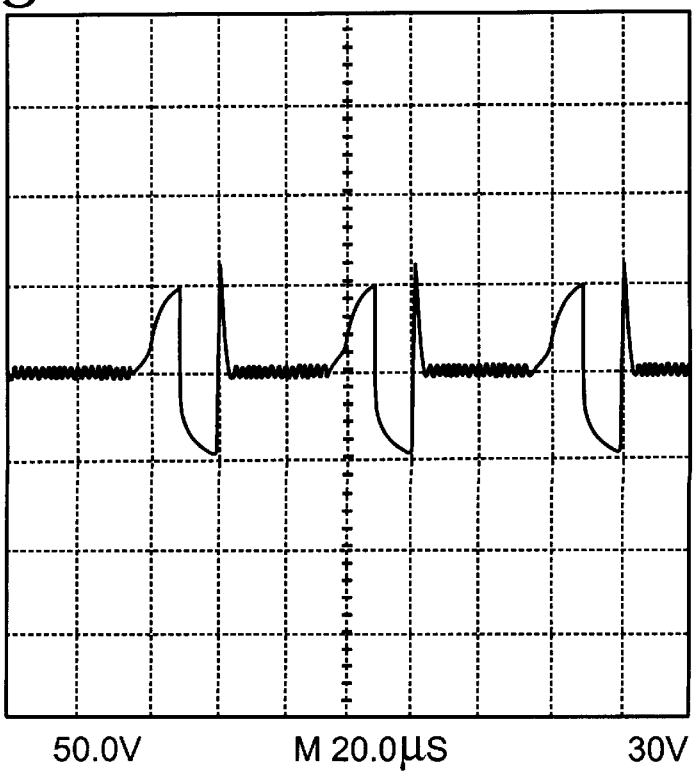

FIGS. 4–9 are voltage signal traces relating to the examples of Table 2 with a fixed pulse width. FIG. 4 is a voltage signal trace showing the breakdown voltage from drive signals 70 corresponding to samples 1 and 2. FIGS. 5–9 are voltage signal traces showing the breakdown voltages from drive signals 70 corresponding to respective samples 3–7. The traces of FIGS. 4–9 also show that in this implementation drive signal 70 for each of samples has a duty cycle of less than 100 percent. The breakdown voltage readings of FIGS. 4–9 are derived as twice the magnitude of the negative-going pulse components. These readings are derived in this way because the prototype implementation upon which the signal traces are based included positive-going voltage transients that appear in the traces. These voltage transients are of such brief duration, however, that they do not significantly affect the power delivered to lamp 12.

An aspect of the implementation described above is that period 78 of drive signal pulses 72 is substantially fixed for all operating current levels, and different current levels are obtained by varying the duty cycle of drive signal pulses 72. In this implementation, the duration of period 78 may be substantially arbitrary so long as drive signal 70 can generate maximum brightness in lamp 12 with a duty cycle of no more than 100 percent. The time periods listed in Table 1 illustrate the time between successive pulses 72.

Another aspect of the implementation described above is that cathode power circuit 50 utilizes cooperation between a voltage-controlled oscillator 130 and a dual monostable multivibrator (one-shot) 132 in a manner substantially similar to that in which voltage-controlled oscillator 90 and dual monostable multivibrator (one-shot) 92 cooperate in arc current driver circuit 44. This implementation of cathode power circuit 50 utilizes components (i.e., voltage controlled oscillator 130 and one shot 132) that are available as a result of the implementation of arc current driver circuit 44.

Voltage-controlled oscillator 130 receives at its analog control input 134 an analog cathode control voltage provided by a digital to analog converter 140 connected to a cathode current memory circuit 34. Voltage-controlled oscillator 130 generates a square wave output signal having a frequency corresponding to the magnitude of the analog cathode control voltage. The square wave output signal is delivered to a first monostable multivibrator 144 of dual monostable multivibrator 132.

First monostable multivibrator 144 triggers on a leading edge of the square wave output signal and generates a one-shot output pulse. As this one-shot output pulse goes low, a complementary one-shot output pulse goes high. The complementary one-shot output pulse is delayed by a resistor-capacitor pair 146 and is delivered to a second monostable multivibrator 148 of dual monostable multivibrator 132 to trigger therefrom a one-shot output pulse having a period set in part by a resistor-capacitor pair 146'. The one-shot output pulses from first and second monostable multivibrators 144 and 148 are coupled via invertering FET drivers 152 and 154 to and drive power transistors 156 and 158, respectively. Power transistors 156 and 158 are connected to respective opposed legs of step-up voltage transformer 160.

Figure 10:
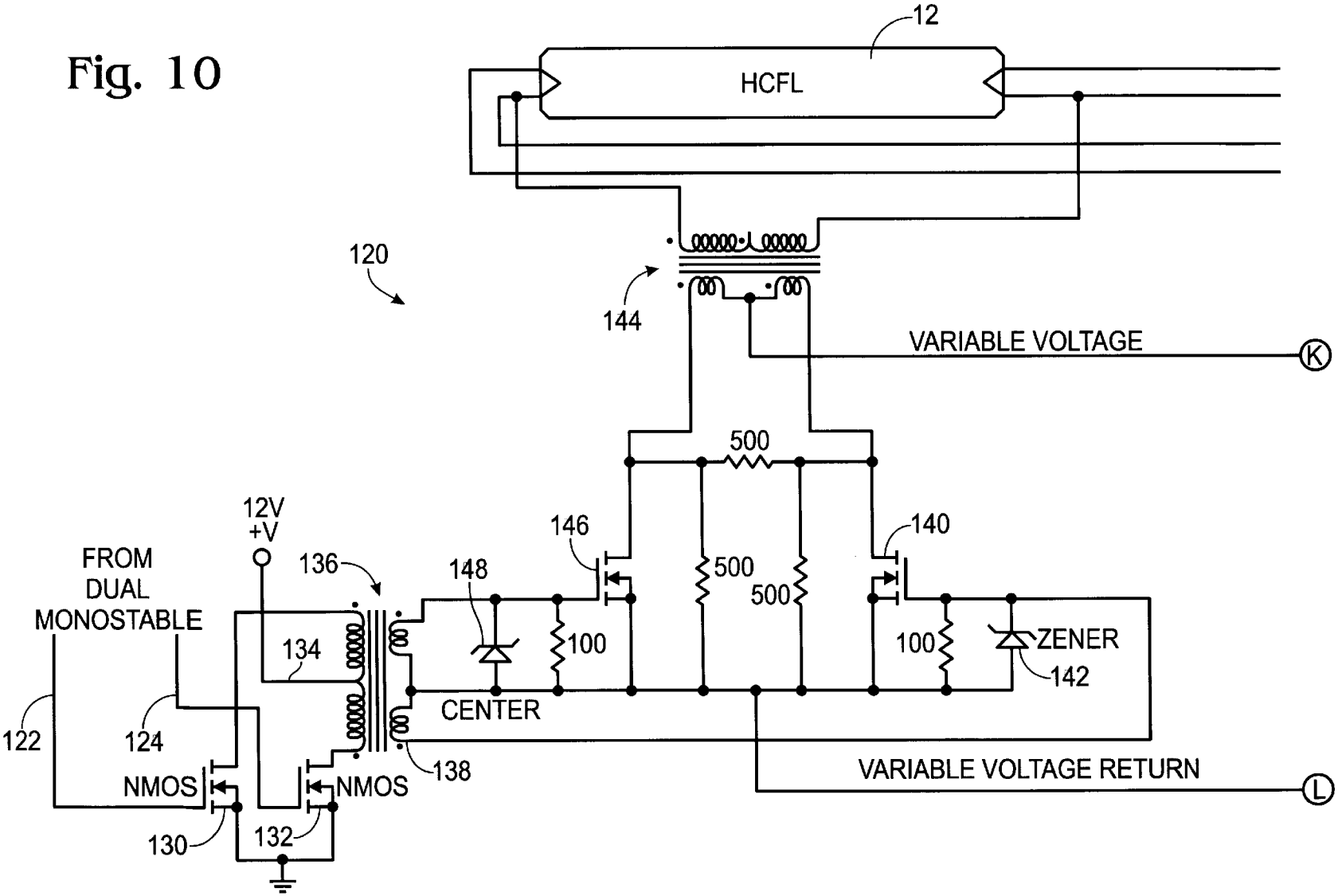
FIG. 10 is a schematic diagram of an alternative lamp drive circuit for use in the controller circuit of FIG. 2.

FIG. 10 is a schematic diagram of another lamp drive circuit 120 that can be used in place of lamp drive circuit 105 shown in FIG. 2. Lamp drive circuit 120 is shown connected to a lamp 12. In an implementation with multiple lamps, a separate lamp drive circuit 120 would be connected to each lamp 12.

Drive circuit 120 includes lines 122 and 124 that connect to respective lines 126 and 128 from dual monostable multivibrator 92. Lines 122 and 124 are coupled to respective MOSFETs 130 and 132, and lines 126 and 128 are normally off. When a pulse appears at line 122, MOSFET 130 momentarily turns on and creates a current path to ground from a 12V supply coupled to a center tap 134 of a transformer 136. This induces current in a secondary coil 138 of transformer 136. The current passes to the variable voltage return 2–3, creates a voltage pulse at the gate of a MOSFET 140 (with the amplitude of the voltage pulse limited by a Zener diode 142) to induce a current pulse in a lamp driver transformer 144.

Next, a positive pulse appears at line 124, which causes a current reversal in secondary coil 138 while the gate of a MOSFET 146 is driven in the same manner as MOSFET 140. Th current reversal in secondary coil 138 causes the voltage at the gate of MOSFET 140 to momentarily go negative, as limited by a forward voltage drop across Zener diode 142. This actively removes any gate charge on MOSFET 140 to ensure that it is completely turned off. At the next current reversal in response to another pulse from dual monostable multivibrator 92, the effects described above with respect to MOSFET 140 and Zener diode 142 are instead applied to MOSFET 146 and a Zener diode 148, and vice versa. Each current reversal induces a voltage across lamp 12 for driving its light-generating arc.

In view of the many possible embodiments to which the principles of our invention may be applied, it should be recognized that the detailed embodiments are illustrative only and should not be taken as limiting the scope of our invention. For example, while this implementation employs a programmed controller (e.g., a microcontroller) and other digital circuitry, it will be appreciated that the arc current and arc voltage could in the alternative be controlled separately by digital circuitry without a programmed controller or by analog circuitry. Accordingly, the invention includes all such embodiments as may come within the scope and spirit of the following claims and equivalents thereto.

What is claimed is:

1. A gas discharge lamp controller for controlling a gas discharge lamp, comprising:

a memory storing for each of plural lamp illumination brightnesses a current value and a voltage value corresponding to a discharge current and a discharge voltage for illuminating the lamp at a selected one of the plural brightnesses;

a current controller coupled to the lamp and delivering thereto a discharge current corresponding to the current value of the selected brightness; and a voltage controller coupled to the lamp and delivering thereto a discharge voltage that corresponds to the voltage value of the selected brightness.

2. The controller of claim 1 in which the memory includes a digital memory and the current and voltage values are stored in the digital memory as digital values.

3. The controller of claim 1 in which the current controller delivers the discharge current as plural successive current pulses.

4. The controller of claim 3 in which the current pulses of the plural brightnesses are of selected periods that are controlled separately from the current and the voltage.

5. The controller of claim 4 in which the selected periods are digitally controlled.

6. The controller of claim 3 in which the current pulses of the plural brightnesses are of a single selected period.

7. The controller of claim 1 in which the current controller and the voltage controller are digitally controlled.

8. The controller of claim 1 in which the current controller includes a voltage controlled oscillator and a dual monostable multivibrator that cooperate to generate an arc current signal pulses corresponding to the discharge current.

9. The controller of claim 1 coupled to a gas discharge lamp and driving it at illumination brightnesses having a dimming ratio of at least 20,000:1.

10. The controller of claim 1 in which the dimming ratio is at least 90,000:1.

11. The controller of claim 1 in which the current controller and the voltage controller provide the respective discharge current and discharge voltage independent of each other.

12. The controller of claim 1 in which the current controller and the voltage controller are coupled to the lamp and are not coupled to and do not include a load ballast.

13. A method of controlling a discharge lamp at plural illumination brightesses, comprising:

storing a current value and a voltage value for each of plural selected discharge currents and discharge voltages, respectively; and generating a selected discharge current and a separately controllable selected discharge voltage from stored current and voltage values and applying the selected discharge current and the selected discharge voltage to the discharge lamp for each of the plural illumination brightesses.

14. The method of claim 13 in which the selected discharge voltages for lower illumination brightnesses are greater than the selected discharge voltages for higher illumination brightnesses.

15. The method of claim 14 in which the selected discharge voltages for lower illumination brightnesses are greater than the selected discharge voltages for higher illumination brightnesses by an amount sufficient to provide the lamp with a dimming ratio greater than 20,000:1.

16. The method of claim 14 in which the selected discharge voltages for lower illumination brightnesses are greater than the selected discharge voltages for higher illumination brightnesses by an amount sufficient to provide the lamp with a dimming ratio of about 90,000:1.

17. The method of claim 13 in which applying the selected discharge current includes generating plural current pulses of a selected duty cycle.

18. The method of claim 17 in which different selected discharge currents for different ones of the plural illumination brightnesses plural current pulses of the same period and different duty cycles.

19. The method of claim 17 in which generating the current pulses includes triggering a dual monostable multivibrator to form the current pulses.

20. The method of claim 17 in which generating the current pulses includes applying a control signal corresponding to the selected duty cycle to a voltage controlled oscillator to generate an oscillation frequency that establishes the selected duty cycle.

21. The method of claim 13 in which applying the selected discharge current includes generating plural current pulses.

22. The method of claim 21 in which the current pulses of the plural brightnesses are of selected periods that are controlled separately from the discharge current and the discharge voltage.

23. The method of claim 21 in which in which the current pulses of the plural brightnesses are of selected periods and different duty cycles.

24. The method of claim 21 in which the plural current pulses for lower illumination brightnesses have shorter periods than the plural current pulses for higher illumination brightnesses.

25. The method of claim 21 in which the discharge lamp is included in a liquid crystal display backlight.

26. The method of claim 13 further comprising applying the selected discharge current and the separately controllable selected discharge voltage to the discharge lamp without applying them to or through a load ballast.

27. In a combination gas discharge lamp and gas discharge lamp controller that provide a range of illumination brightnesses, the improvement comprising:

a dimming ratio between maximum and minimum flicker-free bightnesses of more than 20,000:1.

28. The combination of claim 27 in which the dimming ratio is at least 90,000:1.

29. The combination of claim 27 further comprising:

a memory storing for each of plural lamp illumination brightnesses a current value corresponding to a discharge current for illuminating the lamp at the brightnesses; and a current controller coupled to the lamp and delivering thereto a discharge current corresponding to the current value of a selected brightness.

30. The combination of claim 27 further comprising:

a memory storing for each of plural lamp illumination brightnesses a voltage value corresponding to a discharge voltage for illuminating the lamp at the brightnesses; and a voltage controller coupled to the lamp and delivering thereto a discharge voltage corresponding to the voltage value of a selected brightness.

31. The combination of claim 30 in which the memory stores voltage values to provide for lower illumination brightnesses discharge voltages that are greater than the discharge voltages for higher illumination brightnesses.

32. In a gas discharge lamp controller for controlling a gas discharge lamp, plural discharge current control signals for providing plural discharge currents to illuminate the gas discharge lamp at plural illumination brightnesses, each of the signals comprising:

a discharge current pulse of a pulse period; and a duty cycle that cooperates with the pulse period of the discharge current pulse to provide a discharge current for a selected illumination brightness.

33. The controller of claim 32 in which the pulse period for each of the discharge current control signals is the same.

34. The controller of claim 32 in which the discharge current pulse is generated by cooperation between a voltage controlled oscillator and a dual monostable multivibrator.

35. The controller of claim 32 in which the pulse period for each of the discharge current control signals is one of plural different pulse periods corresponding to the selected illumination brightness.

36. The controller of claim 35 in which the pulse period for a lower illumination brightness is shorter than the pulse period for a higher selected illumination brightness.

* * * * *